United States Patent [19]

Bray

[11] 4,368,782

[45] Jan. 18, 1983

[54] ON/OFF SPRINKLER HEAD WITH TEMPERATURE RESPONSIVE EXHAUST PORT VALVE

[75] Inventor: Geddes A. Bray, Moston, England

[73] Assignee: Mather & Platt Limited, Manchester, England

[21] Appl. No.: 124,670

[22] Filed: Feb. 26, 1980

[30] Foreign Application Priority Data

Feb. 28, 1979 [GB] United Kingdom ..... 7906982

[51] Int. Cl.[3] ..... A62C 37/20

[52] U.S. Cl. ..... 169/90; 169/42

[58] Field of Search ..... 169/19, 37, 38, 39, 169/40, 41, 42, 56, 57, 60, 90; 137/72, 79, 457, 491; 236/996, 99 K, 100

[56] References Cited

U.S. PATENT DOCUMENTS

| | | | |
|---|---|---|---|
| 1,771,826 | 7/1930 | Taylor | 169/38 |
| 2,661,805 | 12/1953 | Lim | 169/41 |
| 3,048,676 | 11/1974 | Doherty, Jr. | 169/90 X |
| 3,791,450 | 2/1974 | Poitras | 169/42 X |
| 3,924,687 | 12/1975 | Groos | 169/19 |
| 3,991,829 | 11/1976 | Johnson | 169/19 |
| 4,099,573 | 7/1978 | Sahara | 169/37 |

FOREIGN PATENT DOCUMENTS

| | | | |
|---|---|---|---|
| 2434721 | 2/1975 | Fed. Rep. of Germany | 169/90 |
| 52-56799 | 5/1977 | Japan | 169/90 |
| 52-58297 | 5/1977 | Japan | 169/90 |

*Primary Examiner*—Gil Weidenfeld
*Assistant Examiner*—Fred A. Silverberg
*Attorney, Agent, or Firm*—Sughrue, Mion, Zinn, Macpeak & Seas

[57] ABSTRACT

An on/off sprinkler has a body defining an extinguishant inlet and outlet and is divided internally by a diaphragm defining with the body an intermediate chamber and normally isolating the inlet from the outlet. The diaphragm has a drain orifice allowing an extinguishant pressure balance on both sides of the diaphragm. There is an exhaust port from the intermediate chamber which is normally closed by a valve controlled by a heat sensitive device serving upon attainment of a predetermined temperature value to open the valve thus causing extinguishant exhaustion from the intermediate chamber which results in diaphragm movement to place the inlet in communication with the outlet and sprinkler operation.

1 Claim, 10 Drawing Figures

ON/OFF SPRINKLER HEAD WITH TEMPERATURE RESPONSIVE EXHAUST PORT VALVE

BACKGROUND OF THE INVENTION

This invention relates to on/off sprinklers for use in sprinkler fire-fighting equipment.

It is an object of the present invention to provide an on/off sprinkler which is simpler in construction and less likely to become, due to the passage of time, non-operational than known on/off sprinklers, due, for example, to the omission of relatively sliding components in the sprinkler construction.

According to the present invention there is provided an on/off sprinkler comprising a body having a fire extinguishant inlet spaced from a fire extinguishant outlet, a flexible diaphragm within the body normally isolating the inlet from the outlet save for a leakage path between the inlet and an intermediate chamber defined by the diaphragm and body, whereby an extinguishant pressure balance is attained at both sides of the diaphragm, and normally-closed exhaust port means openable, upon attainment of a predetermined first temperature value, to cause extinguishant pressure imbalance with consequent diaphragm movement connecting the inlet to the outlet, and closable upon attainment of a predetermined second temperature value.

Preferably, the leakage path is provided by a leakage orifice in the diaphragm.

Preferably also, the diaphragm is spring-urged to its isolating position to assist pressure balance.

Preferably also, the diaphragm in its isolating position abuts an internal seat in the hollow body.

The exhaust port means may comprise a port from the intermediate chamber normally closed by an open/-close valve movable under the influence of a heat sensitive device external of the sprinkler body.

The heat sensitive device may be a bimetallic disc connected to the valve by a stem.

An extinguishant deflector is preferably provided on the valve stem between the valve and bimetallic disc to prevent cooling of the latter on intermediate chamber exhaustion.

The intermediate chamber may have first and second exhaust ports normally closed by first and second valves releasably held in closed position by first and second heat sensitive devices, one of said valves being an open/close valve while the other is a close-to-open valve, a third and open-to-close valve being held in the intermediate chamber and being adapted to replace and close the exhaust port normally closed by the close-to-open valve on exhaustion of the intermediate chamber.

The open-to-close valve is preferably held clear of its exhaust port by the open/close valve so that, when there is predetermined temperature decrease, the open-to-close valve will have closed its exhaust port and the open/close valve will have returned to its original position to close its exhaust port.

The intermediate chamber may have an exhaust port normally closed by a close-to-open valve openable due to the action of a heat sensitive device, a second and open-to-close valve movable to close the exhaust port being held clear of the latter by a second heat sensitive device until the predetermined temperature decrease is achieved.

The second heat sensitive device preferably operates a pivotal lever adapted to maintain the open-to-close valve clear of the exhaust port.

Alternatively, the second heat sensitive device operates a bellows arrangement operable to maintain the open-to-close valve clear of the exhaust port.

Figure 9:
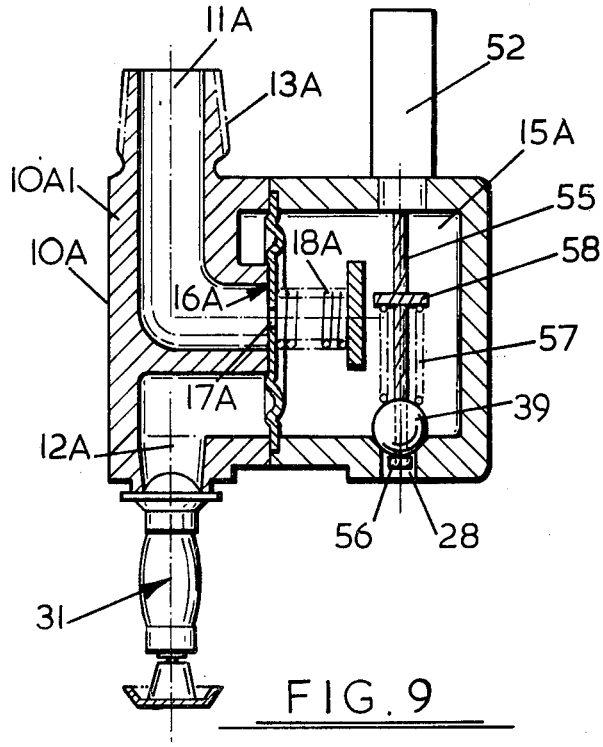

and,

FIG. 9 is a sectional view of a seventh embodiment of an on/off sprinkler according to the invention.

DESRIPTION OF THE PREFERRED EMBODIMENTS

It is to be noted that any convenient heat sensitive device can be used with the on/off sprinklers disclosed and claimed herein. Merely as an example we mention in addition to bimetallic strips, control struts and wax motors referred to specifically herein shaped memory metal effect motors.

Figure 1:
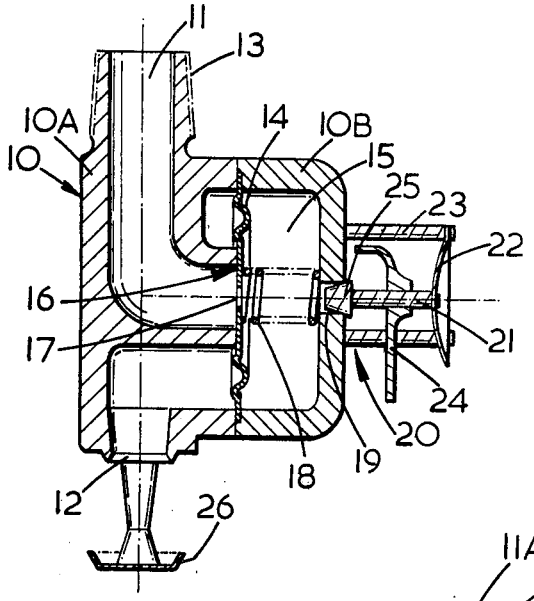
FIG. 1 is a sectional view of a first embodiment of an on/off sprinkler according to the invention.

In FIG. 1 of the drawings, the on/off sprinkler comprises a body 10 which has a normally-open extinguishant inlet 11 and a normally-open extinguishant outlet 12 at opposed ends thereof.

The most commonly used fire extinguishant used is water and we shall refer in the following description to "water" for convenience.

The body 10 at its inlet 11 is externally scew-threaded as indicated at 13 to permit the sprinkler to be screwed into the pipework of a fire extinguishing system. The body 10 is in two parts 10A and 10B suitably secured together with a flexible diaphragm 14 clamped therebetween.

The diaphragm 14 and body part 10B define a chamber 15 disposed, in terms of water flow, intermediate the inlet 11 and outlet 12.

The inlet 11 and outlet 12 are defined by body part 10A which has an internal seat 16 against which the diaphragm 14 normally seats to isolate the inlet 11 from the outlet 12.

The diaphragm 14 has a central orifice 17 which provides a leak path between the inlet 11 and intermediate chamber 15.

The intermediate chamber 15 contains a compression spring 18 connected between the wall of the body part 10B and the flexible diaphragm 14 and which serves to assist constrainment of the flexible diaphragm 14 into contact with the seat 16. The spring is, however, not essential and may be omitted from this embodiment and the subsequently described embodiments. The chamber 15 is also provided with an exhaust port 19 in body part 10B to permit communication of the chamber 15 with atmosphere. The exhaust port 19 is normally closed by a stemmed open/close valve 20, the valve stem 21 being fixed at its opposite end to a bimetallic disc 22 mounted externally of the body part 10B on a bracket 23 mounted on the sprinkler body 10. A water deflector 24 is mounted on the stem 21 between the valve member 25 and bimetallic disc 22 to shield the latter.

The water outlet 12 is open as aforesaid and has a deflector 26 mounted thereat on the sprinkler body 10.

The sprinkler is, as aforesaid, screw-threaded into the pipework of a water supply system and when pressure is applied to the system, water under pressure is admitted, *via* the central leak orifice 17 in the flexible diaphragm 14, to the intermediate chamber 15. The flexible diaphragm 14 under the combined influence of the compression spring 18 and water pressure, is balanced and seated against the seat 16 to isolate the water outlet 12 from the water inlet 11.

In the event of an increase in temperature in the vicinity of the on/off sprinkler, as in the case of a fire, the bimetallic disc 22 reacts and withdraws the stemmed valve 20 from the exhaust port 19 of the intermediate chamber 15 allowing the water therein rapidly to exhaust to atmosphere. The water pressure balance on the diaphragm 14 is thus destroyed causing the diaphragm 14 to be moved away from the seat 16 under the influence of the water supply causing pressure, and water to pass to and discharge from the outlet 12 at which the deflector 26 assists in spreading the water over the fire area.

When the fire is brought under control the consequential reduction in temperature influences the bimetallic disc 22 to move the stemmed valve 20 to close the exhaust port 19. Water again leaks into the chamber 15 through the central orifice 17 in the flexible diaphragm 14 so that water pressure builds up in the chamber 15 and as water pressure balance is attained the diaphragm 14 automatically closes against the seat 16 to isolate the inlet 11 from the outlet 12 and so interrupt the discharge of water from the sprinkler.

It is most important to note that in this embodiment of the on/off sprinkler and all subsequent embodiments that should the central orifice of the diaphragm become blocked this will in no way interfere with the operation of the sprinkler in the event of a fire. It will only result in non-closure of the sprinkler when the temperature has dropped sufficiently which is clearly substantially more desirable than premature sprinkler closure.

Moreover, it should be noted that in this embodiment of the on/off sprinkler and all subsequent embodiments save for the control strut referred to hereinafter that all the operational components of the sprinkler are, during fire extinguishing water flow, shielded from the latter by the diaphragm.

Figure 2A:
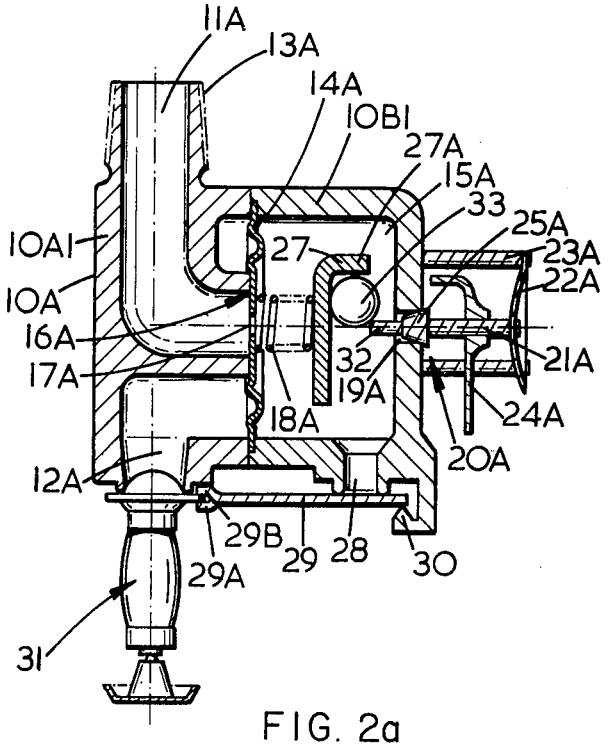
FIGS. 2*a* and 2*b* is a sectional view of a second embodiment of an on/off sprinkler according to the invention incorporating two modes of operation.
Figure 2B:
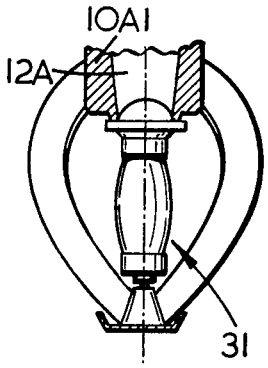

Reference is now made to FIGS. 2*a* and 2*b* in which parts identical with those of the sprinkler of FIG. 1 have the same references with the suffix "A" save references 10A and 10B which have the suffix "1".

In this embodiment the spring 18A which assists to urge the flexible diaphragm 14A against the seating 16A reacts against an internal division wall 27 in body part 10B1. The latter has a second exhaust port 28 in its bottom wall, which port is normally closed by a beam 29 supported at one end in a knife-edge formation 30 of body part 10B1 and at its other end under the valve of a conventional control strut 31 known as the QUARTZOID (Registered Trade Mark) bulb or by any other known suitable heat responsvie device which closes the outlet 12A.

The beam 29 instead of being supported in the knife-edge formation 30 may be bent around the sprinkler body and supported there on a knife edge. The other end of the beam 29 has three tines or fingers, two 29A under the valve and one 29B over the valve so that when the strut 31 operates and the valve falls to open the outlet 12A the beam 29 is carried away thereby.

The stemmed valve 20A has its stem 21A extended internally of the exhaust port 19A as indicated at 32, which extension 32 normally supports a valve ball 33 against the wall 27 and an overhang 27A thereof above and clear of the exhaust port 28.

This sprinkler thus combines the characteristics of a conventional sprinkler with the characteristics of an on/off sprinkler.

Here again, the flexible diaphragm 14A is normally maintained against its seating 16A by balanced water/-spring pressure forces, both exhaust ports 19A /and 28 being closed.

In the event of an increase in temperature in the vicinity of this sprinkler, as in the case of a fire, the sprinkler operates as follows:

The conventional control strut 31 falls away, i.e. the QUARTZOID bulb bursts, allowing disengagement of the beam 29, which opens the exhaust port 28 of the intermediate chamber 15A. The pressure in the intermediate chamber 15A will rapidly exhaust to atmosphere, thus allowing the flexible diaphragm 14A to open under the influence of the water supply pressure, and water to discharge from the outlet 12A in the conventional manner to extinguish the fire.

The increase in temperature also causes the bimetallic disc 22A to respond withdrawing the stemmed valve 20A from exhaust port 19A thus assisting water exhaustion from the intermediate chamber 15A and allowing the ball 33 to drop and close the exhaust port 28.

It will be manifest that, in general, the control strut 31 and bimetallic disc 22A will operate simultaneously or with only slight time differential. However, whatever the sequence of operation, water will be rapidly exhausted from intermediate chamber 15A, the diaphragm 14A will move to connect inlet 11A to outlet 12A and the ball 33 will drop to close exhaust port 28.

When the fire is brought under control the consequential reduction in temperature will influence the bimetallic disc 22A to move the stemmed valve 20A to close the exhaust port 19A. Both exhaust ports 19A and 28 are now closed and leakage of water through the central orifice 17A in the flexible diaphragm 14A allows water pressure to build up in the intermediate chamber 15A to cause the flexible diaphragm 14A automatically to close against the seat 16A to interrupt the discharge of water from the sprinkler. This arrangement permits water discharge only if the control strut 31 operates save for a small flow which would occur should only the bimetallic disc 22 operate.

It is to be noted that the stemmed valve 20, 20A does not have a clearance guide or gland in sliding contact with the sprinkler body 10, and that, as aforesaid, the valve stem 21, 21A is fitted with the water deflector 24, 24A which will prevent water issuing from the exhaust port 19, 19A impinging on the bimetallic disc 22, 22A and thus cooling it.

In the following description of subsequent embodiments parts identical to those in FIG. 2 are referenced with the same reference numerals.

Figure 3:
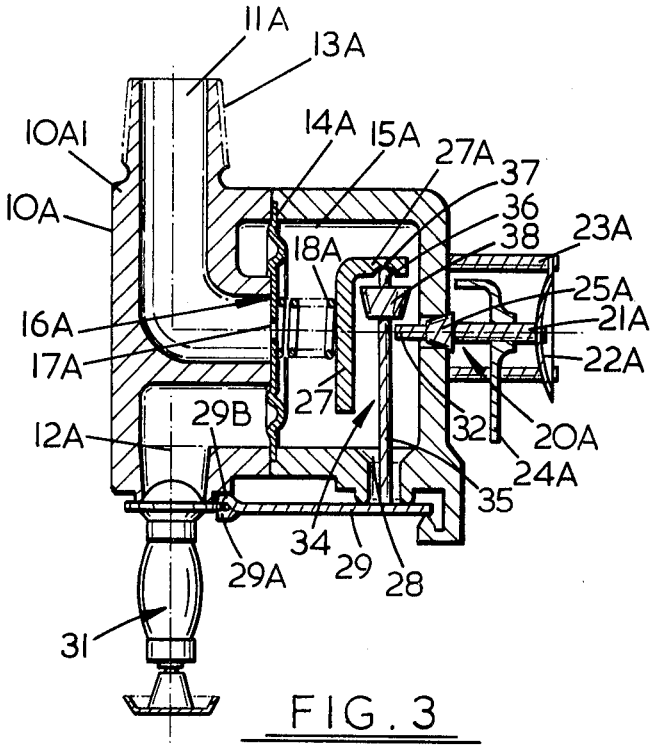
FIG. 3 is a sectional view of a third embodiment of an on/off sprinkler.

In FIG. 3, the ball 33 is replaced by a stemmed valve 34 similar to stemmed valve 20A, the stem 35 of valve 34 normally resting on the beam 29 and the stem extension 36 engaging in a guide recess 37 in the overhang 27A of internal division wall 27.

The extension 32 prevents the valve 38 from being released unless correct operation of the bimetallic disc 22A occurs resulting from temperature increase. If only the control strut 31 operates the extension 32 will prevent the valve member 38 from closing the exhaust port 28 and the sprinkler will discharge water through the outlet 12A. If the bimetallic disc 22A operates then the extension 32 will be withdrawn and the valve member 38 will drop to close the exhaust port 28 so that the sprinkler will then have on/off characteristics.

When the sprinkler has operated to exhaust water from the intermediate chamber 15A, the beam 29 having fallen away and the valve member 38 of the stemmed valve 34 engaging in exhaust port 28 to close same, the stem 35 protruding out of the sprinkler body 10A through the exhaust port 28 will indicate to an observer closure of the latter by the valve member 38.

Referring to FIGS. 4 to 8, it should be noted that as with the FIG. 1 embodiment there is only one exhaust port from the intermediate chamber of the sprinkler. However, while in the FIG. 1 embodiment the exhaust port is controlled by a single open/close valve it should be noted that in these other embodiments the exhaust port is controlled by a close-to-open valve serving to permit sprinkler operation and an open-to-close valve serving to shut down the sprinkler. Both valves are, of course, movable under the influence of a convenient heat sensitive device. More specifically, the bimetallic disc 22A operates on an auxiliary open-to-close valve 39 which closes the exhuast port 28 normally closed by the close-to-open beam 29. This has the advantage that mischievous or inadvertent operation of the bimetallic disc does not cause water to issue from the outlet 12A of the sprinkler. Moverover, failure of the bimetallic disc 22A to operate will not prevent sprinkler operation since operation of the control strut 31 will cause beam 29 to fall away with exhaustion of the chamber 15A, the ball 39 being maintained clear of exhaust port 28 due to its T-stem extension engaging on overhang 42A.

Figure 4:
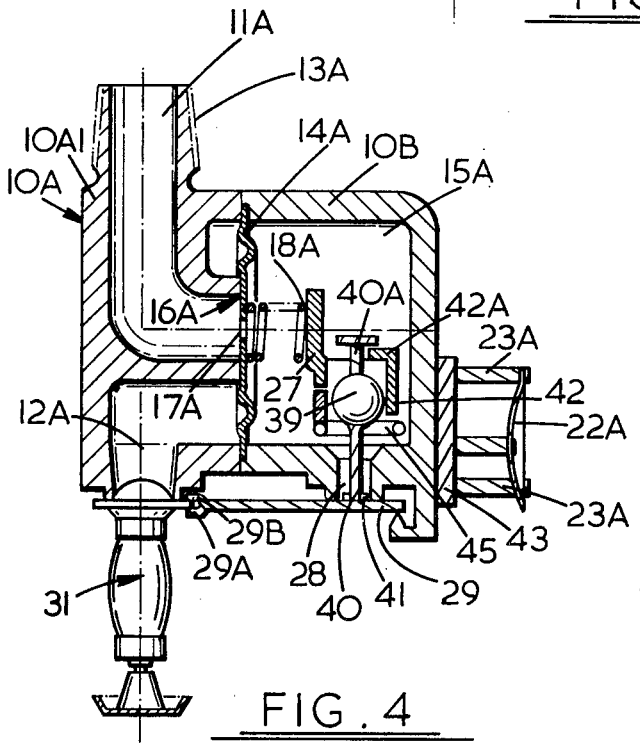
FIGS. 4 and 5 are respectively a longitudinal sectional view and a fragmentary sectional plan view of a fourth embodiment of an on/off sprinkler.
Figure 5:
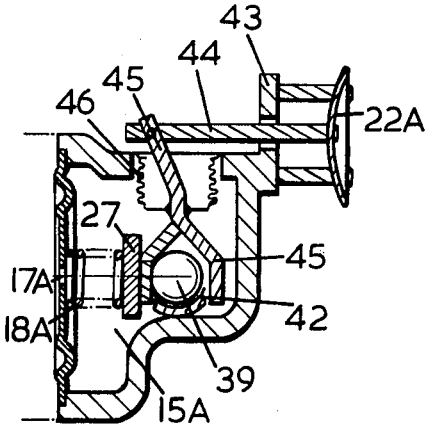

In FIGS. 4 and 5, the open-to-close valve is in the form of a ball 39 having a lower stem 40 and an upper stem extension 40A of T-configuration and which is supported by the stem 40 engaging in a socket 41 of the beam 29. The ball 39 is guided by a sleeve 42 integral with the division wall 27, which sleeve 42 has an overhang 42A over which the cross-bar of the T-stem extension 40A normally lies. It is to be noted that the distance between the overhang 42A and the division wall 27 is greater than the length of the cross-bar of T-stem extension 40A.

The bimetallic disc 22A is supported by its bracket 23A on a wall flange 43 through which extends a stem 44 engaging a pivotal bifurcated lever 45 which projects into the intermediate chamber 15A through a sealing bellows 46, the forked end of lever 45 embracing the stem 40.

If the beam 29 falls away, without the bimetallic disc 22A reacting, the ball 39 will be held clear of the exhaust port 28 by the T-stem extension 40A engaging on the overhang 42A. This will cause exhaustion of intermediate chamber 15A. If now, bimetallic disc 22A reacts, whether the intermediate chamber 15A is fully exhausted or not, the lever 45 unlatches the ball 39 causing same to drop through the guide 42 but impeding its seating on the exhaust port 28 to close same until the bimetallic disc 22A cools and resets.

It will be manifest that any subsequent response by the bimetallic disc 22A to increase in temperature will cause lever 45 to pivot to rock the ball 39 clear of the exhaust port 28 thereby permitting water exhaustion from the intermediate chamber 15A.

If the bimetallic disc 22A reacts to temperature increase before the beam 29 falls away then the ball 39 will be held clear of exhaust port 28 by the lever 45 when the beam 29 does eventually fall away until the bimetallic disc 22A resets.

However, the control strut 31 and bimetallic disc 22A are most likely to operate simultaneously so that there will be immediate exhaustion of water from the intermediate chamber 15A, the ball 39 being maintained clear of the exhaust port 28, unlatched from guide 42, 42A, until predetermined temperature decrease is achieved and the bimetallic disc 22A resets removing the impediment of the lever 45 and allowing the ball 39 to drop onto the exhaust port 28, to close same, the protruding stem 40 indicating such closure.

It is to be noted that in this instance there is no risk of the bimetallic disc 22A being cooled by exhausting water due to the relative positioning of the bimetallic disc 22A and the exhaust port 28.

A modified version of the on/off sprinkler of FIGS. 4 and 5 is envisaged in which the bimetallic disc 22A is so linked to the lever 45 that no relatively sliding parts are involved. The advantage of such construction is that there is substantially less risk of the sprinkler not operating due to parts being "frozen" together as a result, *inter alia,* of passage of time.

Figure 6:
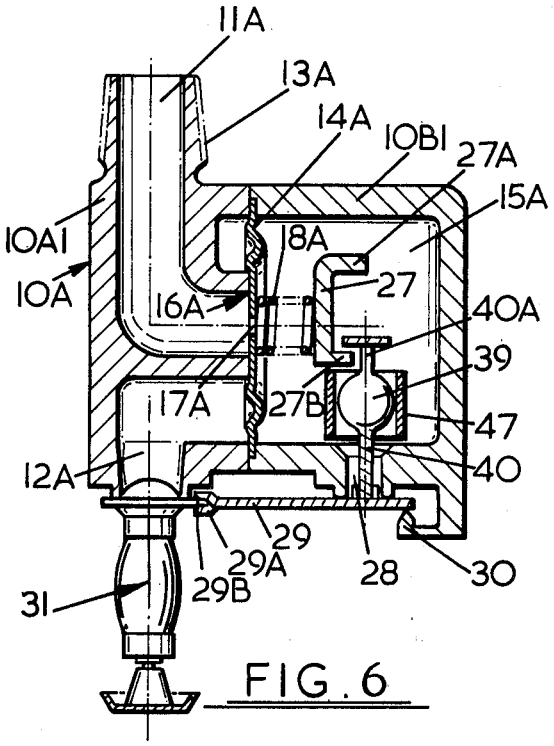
FIGS. 6 and 7 are views similar to FIGS. 4 and 5 of a fifth embodiment of an on/off sprinkler.
Figure 7:
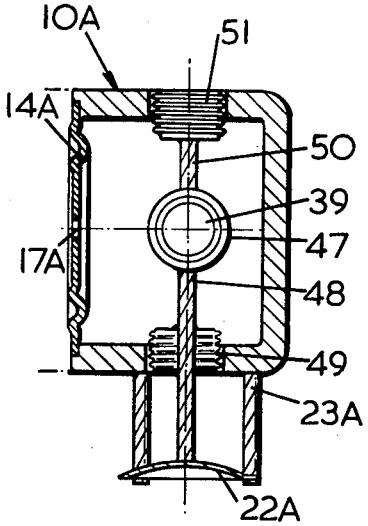

Referring now to FIGS. 6 and 7, the arrangement of the ball 39, stem 40, stem extension 40A and beam 29 is as described with reference to FIGS. 4 and 5.

The T-stem extension normally overlies an extension 27B of the intermediate wall 27 so that if only the control strut 31 reacts causing the beam 29 to fall away the ball 39 will be held clear of the exhaust port 28.

The ball 39 is mounted within a sleeve 47 connected by a rod 48 to the bimetallic disc 22A, which rod 48 traverses a sealing bellows 49. Another rod 50 diametrically opposite rod 48 connects the sleeve 47 to another sealing bellows 51 in the wall of the sprinkler body 10A.

When the beam 29 falls away and the bimetallic strip 22A reacts to temperature increase the stem extension 40A is pulled clear of the extension 27B which is suitably dimensioned to permit this and the ball 39 will fall towards the exhaust port 28, the stem extension 40A now lying below the extension 27B.

However, it will be maifest, in this instance, that inter-action of the bellows 49 and 51, rods 48 and 50 and the sleeve 47 serve to hold the ball 39 clear of the exhaust port 28 until the bimetallic strip 22A returns to normal condition at which time the sleeve 47 is in alignment with the exhaust port 28 and the ball 39 seats on the latter to shut down the sprinkler.

The bellows may be replaced by diaphragm arrangements.

Figure 8:
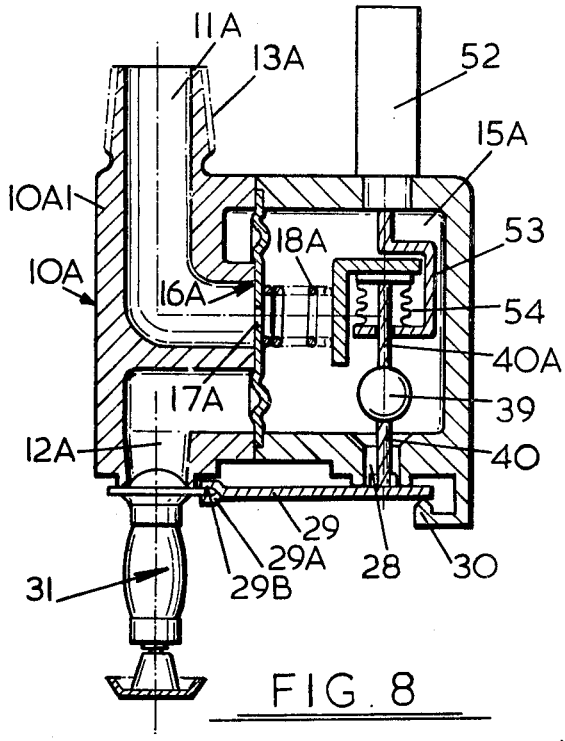
FIG. 8 is a sectional view of a sixth embodiment of an on/off sprinkler according to the invention.

In FIG. 8, the close-to-open valve is again a ball 39 with a stem 40 engaging the beam 29 and having a T-stem extension 40A.

The heat sensitive device is, in this instance, a wax motor 52 to which is connected a catch 53 freely traversed by the T-stem extension 40A. Between the catch 53 and T-stem extension 40A there is a crushable or disengageable member 54.

In the event of the wax motor 52 operating normally, the catch 53 will be moved to crush or cause disengagement of the member 54 and hold the ball 39 clear of the exhaust port 28, thus permitting exhaustion of the intermediate chamber 15A and operation of the sprinkler when the control strut 31 operates to effect disengagement of the beam 29. Upon sufficient temperature reduction, the wax motor 52 will lower the catch 53 thus allowing the ball 39 to fall and seat upon the exhaust port 28 to close the latter and effect sprinkler shut-down.

If for some reason the wax motor 52 does not operate, the ball 39 will be prevented by the crushable or disengageable member 54 from falling onto the exhaust port 28 with premature closure of the sprinkler. In this event, upon temperature reduction to a value which would normally cause sprinkler shut-down, i.e. wax motor operating normally, the sprinkler will simply not close, i.e. the sprinkler is failsafe to open.

The crushable or disengageable member 54 may, *inter alia,* be a bellows, a spring or a collapsible strut.

Reference is finally made to FIG. 9, which again shows a sprinkler having a single exhaust port 28 from the intermediate chamber 15A. In this embodiment, exhaust port 28 is normally closed by the ball 39 which is freely traversed by the piston rod 55 of wax motor 52. A stop 56 at the end of piston rod 55 underlies the ball 39 which is lightly loaded by a spring 57 abutting a flange 58 on the piston rod 55.

Operation of the wax motor 52 causes the ball 39 to be lifted off the exhaust port 28 thus causing exhaustion of the intermediate chamber 15A and with operation of the control strut 31 simultaneously with the wax motor 52, or almost so, then sprinkler operation occurs. Upon sufficient temperature reduction the wax motor 52 moves the ball 39 back onto the exhaust port 28 where it is lightly loaded into closure position by spring 57.

If the wax motor 52 operates incorrectly to open the exhaust port 28 then of course, sprinkler operation is prevented due to the presence of the control strut 31.

This embodiment of sprinkler can be made failsafe to open by making the ball 39 of a fusible material, for example a plastics material having a melting point above the predetermined operational temperature of the wax motor 52 but within the likely temperature range of a fire within the area to be protected by the sprinkler. Melting of ball 39 will cause exhaustion of intermediate chamber 15A and subsequent or immediate sprinkler operation depending upon operation of the control strut 31. In these circumstances sprinkler closure can only be effected by a valve in the water supply pipework.

Instead of making the ball 39 of a fusible material, it may be of metal as usual and an insert of fusible material defining the discharge port 28 may be fitted in the sprinkler body. With this arrangement the insert will melt upon attainment of the predetermined temperature leaving a relatively large orifice with the ball 39 suspended above and clear of same. Here again, sprinkler closure requires closure of a valve in the water supply pipework.

It should be noted that the sliding motions involved in the embodiments of FIGS. 8 and 9 due to the use of the wax motor 52 can be justified due to the operational power of such motor. Suitable screening of the sliding components can be effected by flexible shields, seals or bellows.

What is claimed is:

1. An on/off sprinkler comprising:

a two-part body with one body part defining an L-shaped fire extinguishant inlet passage and an inverted L-shaped fire extinguishant outlet passage, the passages being axially spaced with the outlet opening of the inlet passage and the inlet opening of the outlet passage lying in a common vertical plane, and with the other body part defining with said one body part a communicating chamber between the inlet and outlet passages disposed laterally of said common vertical plane and having upper and lower walls with an exhaust port in the latter;

a flexible diaphragm clamped between the two body parts and lying in said common vertical plane normally to isolate the inlet and outlet passages from the chamber save for a leakage path between the inlet passage and the chamber, whereby an extinguishant pressure balance is attained at both sides of the diaphragm and from one another;

a wall within the chamber parallel with the flexible diaphragm;

a compression spring arranged between the wall and the flexible diaphragm serving to urge the flexible diaphragm into its isolating position;

a wax motor mounted externally of the other body part on the upper wall in vertical alignment with the exhaust port;

a piston rod extending into the chamber from the wax motor and being operable thereby;

a valve member freely mounted on the piston rod and normally serving to close the exhaust port, which valve member is movable by the wax motor and piston rod–

(A) away from the exhaust port to open the exhaust port upon attainment of a first predetermined temperature value to cause extinguishant pressure imbalance with consequent movement of the diaphragm to connect the inlet and outlet passages, and (B) back towards the exhaust port to close same upon attainment of a predetermined second temperature value;

a flange on the piston rod spaced from the valve member; and a spring surrounding the piston rod and arranged between the flange and the valve member and serving to urge the latter in the direction of the exhaust port.

* * * * *